US005499639A

United States Patent [19]

Williams, Jr.

[11] Patent Number: 5,499,639

[45] Date of Patent: Mar. 19, 1996

[54] APPARATUS AND METHOD FOR CLEANING EXCHANGER TUBES

[76] Inventor: Robert V. Williams, Jr., 16 Bay Harbor, La Porte, Tex. 77571

[21] Appl. No.: 431,557

[22] Filed: May 1, 1995

[51] Int. Cl.[6] ..... F28G 9/00; B08B 3/02

[52] U.S. Cl. ..... 134/7; 134/24; 134/167 C; 134/8; 134/22.12; 165/95

[58] Field of Search ..... 165/95; 134/22.12, 134/24, 167 C, 171, 166 C, 7

[56] References Cited

U.S. PATENT DOCUMENTS

| | | | |
|---|---|---|---|
| 1,893,979 | 1/1933 | Barrere | 134/167 C X |
| 4,422,822 | 12/1983 | Nelson et al. | 134/22.18 |
| 4,750,547 | 6/1988 | Sakamoto | 165/84 |
| 5,072,788 | 12/1991 | Goodwin et al. | 165/95 |
| 5,423,917 | 6/1995 | Garcia, Jr. | 134/1 |

*Primary Examiner*—Allen J. Flanigan

*Attorney, Agent, or Firm*—Browning, Bushman, Anderson & Brookhart

[57] ABSTRACT

An apparatus and method for cleaning the tubes of a heat exchanger of a type having at least one header that defines a manifold chamber having a plurality of tubes extending therefrom, the tubes and the header defining tube openings to provide open communication between the tubes and the manifold chamber, the tube openings defining a peripheral seating surface, there being bores in the header, respective ones of which are in register with respective ones of the tube openings, the apparatus comprising a tubular member having a first end and a second end, the tubular member being dimensioned such that the first end can be received through at least one of the bores, a force transmitting lever assembly connected to the tubular member and operatively connected to the header whereby the tubular member can be urged toward the seating surface of a tube opening in register with a bore through which the tubular member is received, there being a seal formed between the tubular member and the seating surface.

17 Claims, 2 Drawing Sheets

FIG. 2
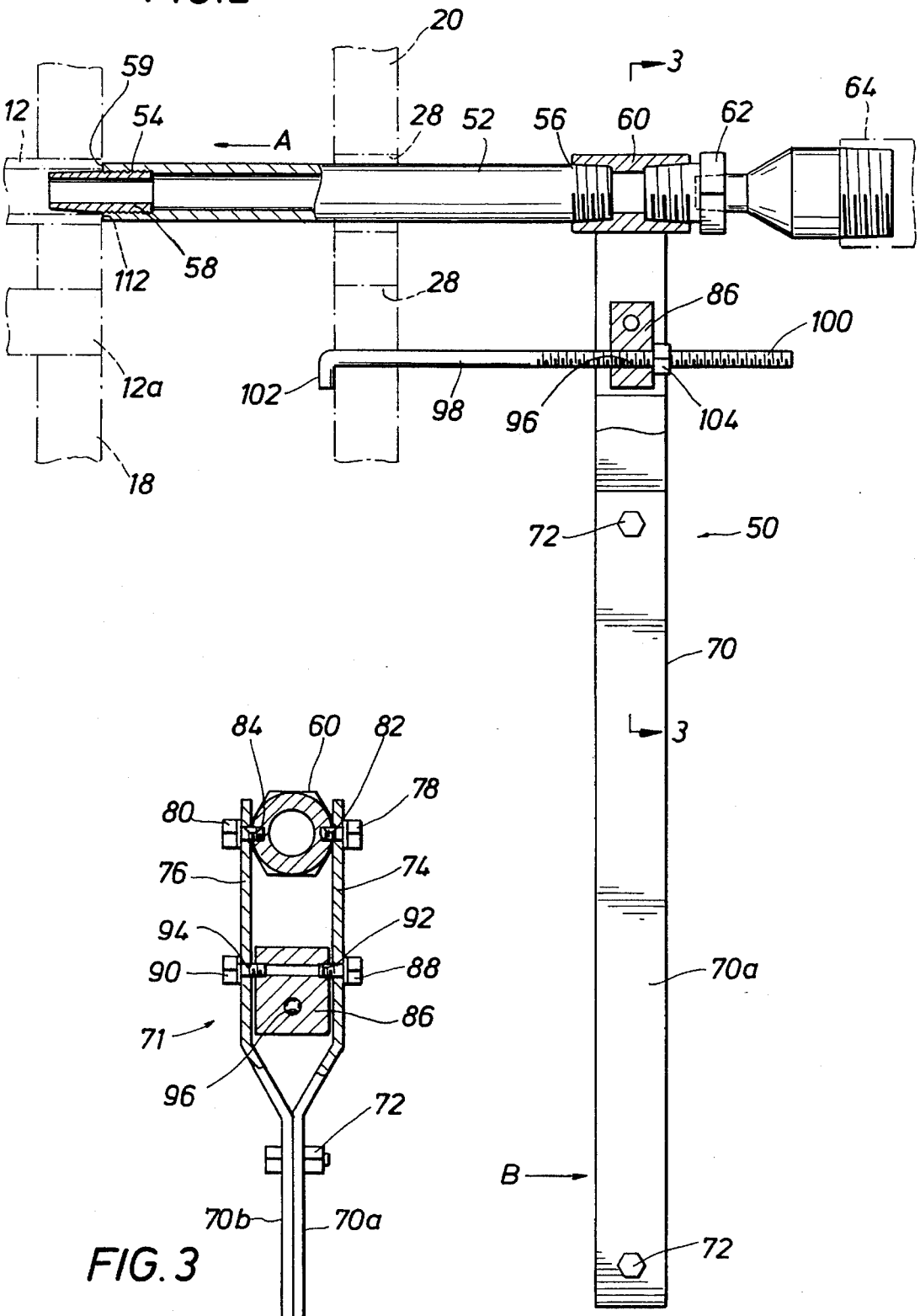
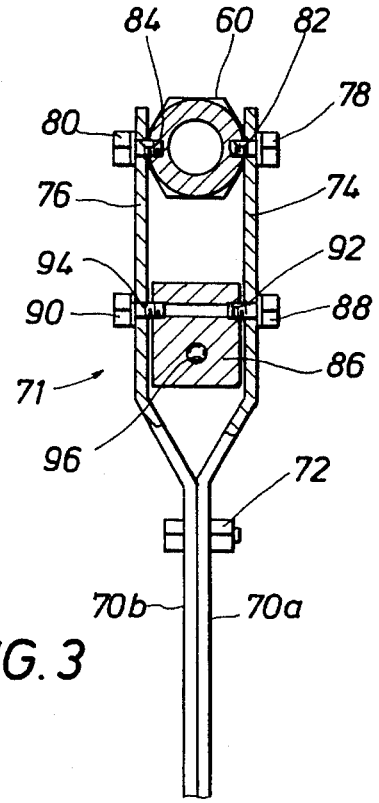
FIG. 3

APPARATUS AND METHOD FOR CLEANING EXCHANGER TUBES

BACKGROUND OF THE INVENTION

1. Field of the Invention

The present invention relates to an apparatus and method for cleaning the interior of tubular bodies such as heat exchanger tubes and, more particularly, to an apparatus and method for cleaning finned (air cooled) heat exchanger tubes.

2. Description of the Prior Art

Air-cooled heat exchangers are used in many applications in the chemical and refining industry and are particularly used in areas of water scarcity. These air-cooled heat exchangers are comprised of externally finned tubes generally disposed horizontally between spaced headers that define manifold chambers whereby a fluid to be cooled can be introduced into one header, pass through the finned tubes to be cooled, and exit through the opposite header. Although the finned tubes are generally cooled by means of fans to enhance their efficiency, finned heat exchangers are generally mounted at elevated locations to take advantage of greater air movement and air that is generally cooler.

As do all heat exchangers, air-cooled, finned exchangers require periodic cleaning of the tubes to remove scale and other deposits that build up on the interior of the tubes and reduce the heat exchange efficiency of the tubes. To date, this has been a time-consuming and often dangerous operation. For one, as noted above, the finned heat exchangers are generally mounted at elevated locations and sometimes require temporary scaffolding to be built so that the tubes can be accessed for cleaning. The prior art cleaning process is labor-intensive and time-consuming. Finned exchangers are generally constructed such that the finned tubes cooperate with the headers to form tube openings, thereby providing open communication between the manifold chambers formed by the headers and the interior of the tubes. In order to access the tubes for cleaning, removable, threaded plugs are received in bores in the header, such bores being in register with the tube openings. Thus, in a typical prior art cleaning method, a removable plug would be removed from the bore on one header and a corresponding plug removed on the opposite header such that a cleaning wand could be inserted through one of the headers into the tube and run up and down the length of the tube to clean the scale, deposits, etc., from the interior surface of the tube. With the plug removed from the opposite header, the cleaning medium and the dislodged scale and other debris can be removed from the tube being cleaned and collected in a suitable fashion. The tubes are typically cleaned with a pressurized air/solids cleaning medium, and it is important that none of the debris and/or solid cleaning medium be deposited in either of the headers lest this cause plugging or contamination when the exchanger is put back into operation.

Accordingly, in the past, the threaded plug would be removed, bored out, and fitted with a nozzle so that the plug/nozzle assembly could be screwed back into the bore until the nozzle effected a metal-to-metal seal with the tube opening. The source of abrasive would then be attached to the plug containing the nozzle to introduce the cleaning medium into the tube being cleaned. On the opposite end of the tube being cleaned, a spanner tube would be attached to a similarly bored-out plug so that the exiting cleaning medium and/or debris could be expelled from the tube without being deposited in the opposite header.

It will readily be apparent that such an operation is extremely time-consuming and, because of the fact that workers conducting the cleaning may be on temporary scaffolding at considerable height, also quite dangerous.

It would therefore be desirable to have an apparatus for cleaning heat exchanger tubes that can be quickly and easily mounted to the exchanger and will minimize the chances of any solid cleaning medium or debris being deposited in the headers of the exchanger. It would also be desirable to collect and contain the debris and cleaning medium in order to prevent environmental contamination and aid in packaging for disposal.

SUMMARY OF THE INVENTION

It is therefore an object of the present invention to provide an improved apparatus for cleaning the tubes of a heat exchanger.

Yet another object of the present invention is to provide an apparatus for cleaning air-cooled heat exchangers of the finned tube type.

Still a further object of the present invention is to provide an apparatus for cleaning the tubes of a heat exchanger that ensures that the cleaning medium and debris dislodged thereby does not collect in the headers of the exchanger.

Still a further object of the present invention is to provide a method of cleaning the tubes of a heat exchanger that is faster and safer than prior art conventional methods and that minimizes or eliminates the deposition of solid cleaning media, such as abrasives, as well as debris, in the headers of the exchanger.

It is another object of the present invention to provide an apparatus for cleaning the tubes of a heat exchanger that permits conveying debris from the exchanger tube and the cleaning medium to suitable collection vessels.

The above and other objects of the present invention will become apparent from the drawings, the description given herein, and the appended claims.

In one embodiment, the present invention provides an apparatus for cleaning the tubes of a heat exchanger of a type having at least one header, and usually two spaced headers interconnected by a series of exchanger tubes. A typical header has first and second, spaced walls defining a manifold chamber therebetween. A plurality of tubes extend from the first wall and have ends that cooperate with the first wall to define tube openings providing open communication between the interior of the tubes and the manifold chamber. Each of the tube openings defines a peripheral seating surface. The second wall of the header is provided with a plurality of bores, respective ones of which are in register with respective ones of the tube openings in the first wall. The apparatus of the present invention for use in cleaning the tubes of such exchangers comprises a tubular member having a first end and a second end and being dimensioned such that the first end of the tubular member can be received through at least one of the bores in the second wall of the header. In a preferred embodiment, guide means are carried by the tubular member such that the tubular member can be brought into register with a tube opening, which is in register with the bore through which the tubular member is received. There are means to effect a substantial seal between the tubular member and the seating surface and force transmitting means connected to the tubular member, said force transmitting means defining a pivot point and being operatively and selectively connectable to the second wall of the header whereby a force exerted on the force transmitting means and acting around said pivot point urges the tubular member toward the first wall. The apparatus can further include a means for supplying a fluidized cleaning medium through the tubular member into the tube or a means for conveying fluidized cleaning medium and/or debris from the tube to a point external of the header.

In another embodiment of the present invention, there is provided a method of cleaning the tubes of the heat exchanger of the type described above wherein a first tubular member is inserted through one of the bores and brought into register with one of the tube openings, which is in register with the bore through which the tubular member is received. The tubular member is releasably connected to one header to establish a first pivot point whereby a force exerted around said first pivot point urges the first tubular member toward the first and second walls of the one header to thereby effect a substantial seal between the first tubular member and the seating surface. A fluidized cleaning medium, e.g., air/particulate abrasive, is introduced through the first tubular member and into the tube.

In a preferred embodiment of the cleaning method, a second tubular member is inserted through one of the bores in the second wall of the opposite header and brought into register with one of the tube openings, which is in register with the bore through which the second tubular member is received and the tube opening in the first header with which the first tubular member is in register. The second tubular member is releasably connected to the second header to establish a second pivot point such that a force exerted around said second pivot point urges the second tubular member toward the first and second walls of the second header and effects a substantial seal between the second tubular member and the seating surface of the tube opening in the second header. The fluidized cleaning medium passing through the tube being cleaned is transported through the second tubular member out of the tube so as to prevent the cleaning medium from being deposited in the manifold chamber of the second header.

BRIEF DESCRIPTION OF THE DRAWINGS

FIG. 2 is an elevational view, partly in section, of the cleaning apparatus of the present invention.

FIG. 3 is a view taken along the lines 3—3 of FIG. 2.

DESCRIPTION OF THE PREFERRED EMBODIMENTS

Figure 1:
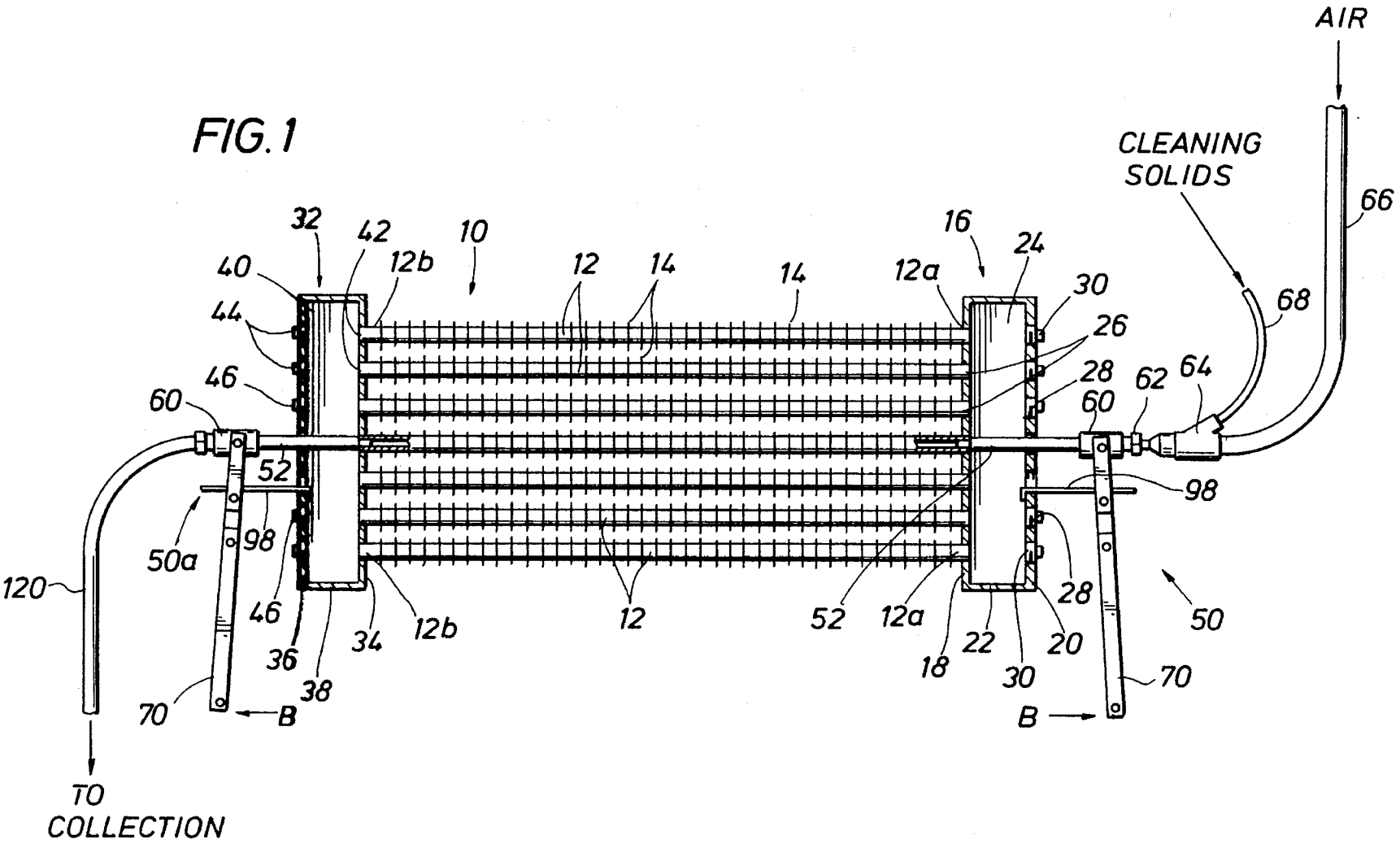
FIG. 1 is an elevational view, partly in section, of a typical finned heat exchanger showing the apparatus of the present invention being used to clean the tubes thereof.

Although the invention will be described with particular reference to the cleaning of heat exchanger tubes of the air-cooled or finned type, it is understood that the invention is not so limited. The cleaning apparatus of the present invention can be used in any tube cleaning application wherein the tubes are connected to a header in a manner similar to that found in a typical finned heat exchanger as hereinafter described.

With reference first to FIG. 1, there is shown a typical finned heat exchanger, shown generally as 10, comprised of a plurality of tubes 12 that define a tube bundle, each of the tubes being provided with a series of fins 14 that enhance heat transfer between the medium inside the tubes 12 and air forced across the tubes 12. Although not necessary, the tubes 12 are generally horizontally disposed and, conventionally, collectively form what is referred to as a tube bundle. The tubes 12 have a first end 12*a* and a second end 12*b*. Each of the first ends 12*a* of the tubes 12 is connected to a first header, shown generally as 16, comprised of a first wall 18 and a spaced, second wall 20 that cooperate with a side wall 22 to form a manifold chamber 24 between first and second walls 18 and 20, manifold chamber 24 being provided with an inlet (not shown) to introduce the fluid to be cooled. First ends 12*a* of tubes 12 cooperate in a well-known manner with first wall 18 to define a first set of tube openings 26 providing open communication between tubes 12 and manifold 24. Second wall 20 of header 16 is provided with a series of threaded bores 28 in which are received threaded plugs 30. Bores 28 in second wall 20 are in register with tube openings 26 in first wall 18.

In like fashion, the second ends 12*b* of tubes 12 are connected to a second header, shown generally as 32, second header 32 having a first wall 34, a spaced second wall 36, and a side wall 38 that cooperate to form a second manifold chamber 40. Although not shown, chamber 40 is provided with an outlet for the removal of cooled fluid passing from chamber 24. First ends 12*b* of tubes 12 cooperate with first wall 34 of second header 32 to form a second set of tube openings 42, which provide open communication between manifold chamber 40 and the interior of tubes 12. Second header 32 is also provided with a plurality of threaded bores 44 in second wall 36, each of which is in register with a respective one of the tube openings 42 and is plugged with a threaded plug 46. In effect, it will be seen that if one of the plugs 30 is removed from a bore 28 in first header 16 and a corresponding plug 46 is removed from a bore 44 in second header 32, an uninterrupted flow path will be formed from the exterior of first header 16 through one of the tubes 12 and through second header 32; i.e., a continuous open bore will appear through the exchanger 10.

As can be seen in FIG. 1, exchanger 10 is equipped with the apparatus of the present invention for the purpose of the tubes 12 being cleaned. To more fully understand the construction and operation of the cleaning apparatus of the present invention, reference is now made to FIGS. 1–3. As shown in FIG. 1, there is an apparatus, shown generally as 50, attached to first header 16 for introducing a cleaning medium into the tubes 12 to clean the tubes 12 and a second apparatus 50*a* attached to second header 32 for allowing the cleaning medium and debris to be expelled from the tubes 12 and collected externally of exchanger 10, i.e., without collecting in second header 32. Apparatuses 50 and 50*a* are alike in all respects with the exception, as seen more fully hereafter, that cleaning apparatus 50 is attached to a means for supplying the fluidized cleaning medium while apparatus 50*a* is attached to a collection conduit to direct the cleaning medium and debris to a suitable collection station externally of exchanger 10. Accordingly, only apparatus 50 will be described in detail, it being understood that apparatus 50*a* is of like construction, with the exception noted above.

Apparatus 50 is comprised of a tubular member 52 (formed of one or more pieces), having a first end 54 and a second end 56. A nozzle 58 is threadedly received to the threaded I.D. of first end 54 of tubular member 52, an annular shoulder 59 thereby being formed on first end 54. Second end 56 of tubular member 52 is externally threaded and is received in the first end of a collar 60. Collar 60 forms a coupling between tubular member 52 and a fitting 62, which in turn is attached, in a well-known manner, to a manifold 64 (see FIG. 1) into which is introduced a pressurized cleaning medium as, for example, in this case pressurized air or some other pressurized gaseous medium via line 66 from a source (not shown) and a particulate solid—e.g., abrasive—through line 68 from a suitable source, e.g., a pressurized pot (not shown). It will be understood that it is not necessary to introduce a source of pressurized gas, e.g., from line 66, and a pressurized particulate solid, e.g., from line 68, through separate lines. Frequently, the gas (air) carrying the solid (abrasive) cleaning medium from the pressurized pot is sufficient to maintain suitable velocities on the solid cleaning medium. Accordingly, manifold 64 could be dispensed with; i.e., a single line feeding a pressurized, particulate solid could be attached to tubular member 52.

Apparatus 50 is provided with a lever 70, which is best seen in FIG. 3 as comprised of two members 70*a* and 70*b*, bolted together with bolts 72, members 70*a* and 70*b* being formed into a yoke shown generally as 71, formed at one end of lever 70 and having spaced-apart tines 74 and 76. Tines 74 and 76 are pivotally connected to collar 60 by means of bolts 78 and 80, which are received through holes in tines 74 and 76, respectively, and threadedly received into bores 82 and 84, respectively, on opposite sides of collar 60.

Disposed between tines 74 and 76 is a mounting block 86, mounting block 86 being pivotally secured to yoke 71 by means of bolts 88 and 90, received through registering holes in fines 74 and 76, respectively, bolts 88 and 90 being threadedly received in threaded, registering bores 92 and 94, respectively, in mounting block 86. Accordingly, mounting block 86 is pivotally mounted to lever 70. As seen hereafter, a pivot point is established defined by the locus of the interconnection of mounting block 86, arm member 98, and lever 70. Mounting block 86 is also provided with a threaded bore 96. An arm member 98, having a threaded end 100, is threadedly received in bore 96. The other end of arm member 98 has a laterally extending finger 102. It can thus be seen that arm member 98 can be adjusted such that the distance of finger 102 from lever 70 can be lengthened or shortened. A locking nut 104 is used to secure arm member 98 at the desired location.

The operation of the cleaning apparatus of the present invention will now be described. Tubular member 52—which although shown as one piece, could be made of several pieces—is dimensioned so as to be received through bore 28 of wall 20, it being understood that plug 30 has been removed. As can be seen with reference to FIG. 2, bore 28 has a larger I.D. than tube opening 12*a*. Thus, while tubular member 52 can be received through bore 28, as shown, the O.D. of tube 52 is too large to be received into tube opening 12*a*. However, nozzle 58 is of a smaller O.D. than the I.D. of tube opening 12*a*, and accordingly, nozzle 58 can be inserted into the opening 12*a* in register with the bore 28 through which tubular member 52 is received. In effect, nozzle 58 performs the function of acting as a guide to assist in bringing tubular member 52 into register with tube opening 12*a*. By forcing tubular member 52 in the direction of arrow A, it will be seen that annular shoulder 59 will be forced against a peripheral seating surface 112 in surrounding relationship to tube opening 12*a* and forming a generally planar annular surface. In effect, with shoulder 59 urged against seating surface 112, a metal-to-metal seal is achieved between tubular member 52 and tube opening 12*a*.

To facilitate sealing engagement between shoulder 59 and seating surface 112, arm member 98 is positioned through an adjacent bore 28 in first wall 20 such that finger 102 hooks on the inside surface of wall 20. In this regard, it will be observed that the distance of finger 102 from mounting member 86 is adjusted such that when annular shoulder 59 is in engagement with seating surface 112, lever 70 is substantially parallel to second wall 20. It will now be observed that if a force is exerted, e.g., by a worker, against lever 70 in the direction shown by arrow B, lever 70 will pivot around the pivot point determined by the interconnection or locus of arm member 98, mounting block 86, and lever 70. Since arm member 98 is hooked to wall 20, tubular member 52 will be forced in the direction shown by arrow A such that shoulder 59 will be urged against seating surface 112. At this point, there will be an effective metal-to-metal seal between tubular member 52 and tube opening 12*a* such that a cleaning medium such as a fluidized air/abrasive mixture can now be introduced through mixing manifold 64, collar 60, tubular member 52, and into tube 12 to dislodge scale and other deposits from the inside surface of tube 12. It will be understood that since the cleaning medium is under pressure and will be propelled through tube 12 from header 16 toward header 32. While it is conceivable that header 32 could be of a type wherein wall 36 is completely removable such that the cleaning medium and any debris would simply be discharged and not be left in header 2, most commonly, header 32 is of the same configuration as header 16, meaning that the cleaning medium and any dislodged debris will collect in header 32 unless conveyed out of tube 12 and externally of header 32. Using the apparatus of the present invention, this can be easily accomplished.

With reference again to FIG. 1, it can be seen that with apparatus 50 in place on first header 16 and apparatus 50*a* in place on second header 32, tubes 52 of apparatuses 50 and 50*a* will be in register with one another; i.e., they will both be engaged in the same tube 12. The cleaning medium comprised of air via line 66 and the solids via line 68 are now introduced through mixing manifold 64 and tubular member 52 and into tube 12, described above, a force being exerted against lever 70 in the direction of arrow B to form the metal-to-metal seal described above. At the same time, with tubular member 52 of apparatus 50*a* in place as shown—i.e., tubular member 52 of apparatus 50*a* is in register with tubular member 52 of apparatus 50—and again with a force being applied against lever 70 of apparatus 50*a* in the direction of arrow B, there will be a metal-to-metal seal between tubular member 52 of apparatus 50*a* and tube opening 42, which is in register with tube opening 26, in which tubular member 52 of apparatus 50 is received. Accordingly, the cleaning medium and any debris removed from the tube 12 being cleaned will be conveyed through tubular member 52 of apparatus 50*a* and sent to an external collection device via collection tube 120, connected to collar 60 of apparatus 50*a*. Essentially, then, no cleaning media or debris will be deposited in either of manifold chambers 24 or 40 or discharged to the environment.

In conducting the method of the present invention, one worker will operate apparatus 50 while the other worker will operate apparatus 50*a*. Once all of the threaded plugs 28 and 46 are removed, the workers can move in a systematic fashion from tube to tube simply by connecting arm 98 to a bore adjacent a bore through which the tubular members 52 are received. Apparatuses 50 and 50*a* are both quick connect and disconnect in the sense that the arms 98 can be quickly and easily releasably locked to the walls 20 and 36 and the tubular members 52 of the apparatuses 50 and 50*a* brought into sealing contact with the tube openings 26 and 42, respectively.

While the apparatus and method of the present invention has been described with particular reference to the arrangement shown in the figures, i.e. , with the pivot point lying between the end of the lever 70 distal tubular member 52, it will be appreciated by those skilled in the art that the relative positions of tubular member 52 and arm member 98 can be reversed such that the pivot point would now be defined by the interconnection or locus of collar 60 and lever 70, in which event to move tubular member 52 toward a respective tube opening and effect sealing between tubular member 52 and the tube opening, the force would be exerted on lever 70 in a direction opposite to that shown by arrow B. Accordingly, and with respect to FIG. 2, in this latter described variation, tubular member 52 would be pivotally connected to lever 70 at generally the same location where mounting block 86 is connected to lever 70 while arm member 98 and mounting block 86 would be connected to lever 70 at generally the same point where tubular member 52 is shown as connected to lever 70. In general, it will be appreciated by those skilled in the art that any arrangement of the tubular member and force transmitting means can be employed wherein the force transmitting means can be connected to the header such that a pivot point or axis can be established and such that a force acting around the pivot point or axis will serve to urge the tubular member 52 toward the tube opening to effect the seal between the tubular member 52 and the tube opening described above.

While sealing between the tubular member 52 and the tube openings, as described, is effected by engagement of an annular shoulder 59 formed between the nozzle 58 and tubular member 52, it will be appreciated that the first end 54 of tubular member 52 can be tapered so as to fit into tube opening 12*a* until the O.D. of the taper on tubular member 52 is substantially the same as the I.D. of tube opening 12*a;* i.e., a peripheral seating surface would be formed internally of tube 12. However, this method has the disadvantage that tubular member 52 can be become too tightly wedged in tube 12, making disengagement difficult and/or worse, causing damage to tube 12 or to the interface between tube 12 and walls 18, 34.

The foregoing description illustrates selected embodiments of the present invention. In light thereof, variations and modifications will be suggested to one skilled in the art, all of which are in the spirit and purview of this invention.

What is claimed is:

1. An apparatus for use in cleaning the tubes of a heat exchanger of a type having at least one header, said header having spaced, first and second walls defining a manifold chamber therebetween, a plurality of tubes extending from said first wall and having ends cooperating with said first wall to define tube openings providing open communication between said tubes and said manifold chamber, each of said tube openings defining a peripheral seating surface, said second wall being provided with a plurality of bores, respective ones of said bores in said second wall being in register with respective ones of said tube openings in said first wall, said apparatus comprising:

a tubular member having a first end and a second end, said tubular member being dimensioned such that said first end of said tubular member can be received through at least one of said bores;

force transmitting means connected to said tubular member and operatively connectable to said second wall, said force transmitting means including a pivot point whereby a force exerted on said force transmitting means and acting around said pivot point urges said tubular member toward the seating surface of a tube opening in register with said bore through which said tubular member is received; and means to effect a substantial seal between said tubular member and said seating surface.

2. The apparatus of claim 1, including guide means operative to assist bringing said tubular member into register with said tube opening in register with said bore through which said tubular member is received.

3. The apparatus of claim 1, including means for supplying a fluidized cleaning medium through said tubular member into said tube.

4. The apparatus of claim 1, including means for conducting a fluidized cleaning medium through said tubular member out of said tube.

5. The apparatus of claim 1, including a nozzle connected to said first end of said tubular member, said nozzle being smaller in diameter than said first end of said tubular member and being dimensioned so as to be received into said tube opening.

6. The apparatus of claim 5 wherein said nozzle and said first end of said tubular member cooperate to form an annular shoulder on said first end of said tubular member and said seating surface defines a planar annular surface in surrounding relationship in said tube opening, said annular shoulder being urged against said seating surface to form said seal.

7. The apparatus of claim 1 wherein said force transmitting means comprises:

a lever member having a first end, said lever member being pivotally connected to said tubular member distal said first end of said tubular member and distal said first end of said lever member; and an arm member having one end releasably connectable to said second wall, said arm member being pivotally connected to said lever member distal said tubular member between said tubular member and said first end of said lever member, said pivot point being defined by the connection between said lever member and said arm member whereby when said arm member is connected to said second wall and said lever member is moved in a direction away from said first and second walls, said tubular member is moved toward said first and second walls.

8. The apparatus of claim 7 wherein said force connecting means includes adjusting means to permit adjusting the distance of said one end of said arm member from said lever member.

9. The apparatus of claim 8 wherein said force transmitting means comprises a collar attached to said second end of said tubular member, said lever member comprising a yoke portion having first and second tines, said collar being received between and pivotally connected to said first and second tines.

10. The apparatus of claim 9 wherein said force transmitting means further comprises a mounting block disposed between said first and second tines and pivotally connected thereto.

11. The apparatus of claim 10 wherein said mounting block includes a threaded bore extending therethrough and said arm member has a threaded second end, said threaded second end being received in said threaded bore in said mounting block.

12. The apparatus of claim 11 wherein said one end of said arm member comprises means for attaching to said second wall through a bore adjacent to said bore through which said tubular member is received.

13. The apparatus of claim 3 wherein said means for supplying a fluidized cleaning medium comprises means connected to said tubular member to supply a fluidized mixture of air and particulate solids.

14. A method for cleaning the tubes of a heat exchanger of a type having at least one header, said header having spaced, first and second walls defining a first manifold chamber therebetween, a plurality of tubes extending from said first wall and having first ends cooperating with said first wall to define a first set of tube openings providing open communication between said tubes and said manifold chamber, each of said tube openings of said first set defining a peripheral seating surface, said second wall of said one header being provided with a plurality of bores, respective ones of said bores in said second wall of said one header being in register with respective ones of said tube openings of said first set, said method comprising:

introducing a first tubular member through one of said bores in said second wall of said one header;

bringing said first tubular member into register with one of said tube openings of said first set in register with said bore through which said first tubular member is received;

releasably connecting said first tubular member of said one header to said second wall to establish a first pivot point whereby a force exerted around the first pivot point urges said first tubular member toward said first and second walls of said one header;

exerting said force to effect a substantial seal between said first tubular member and said seating surface; and introducing a fluidized cleaning medium through said first tubular member into said tube.

15. The method of claim 14, including providing a lever assembly for effecting connection of said first tubular member to said second wall of said one header and for transmitting said force to said tubular member.

16. The method of claim 14 wherein said fluidized cleaning medium comprises a mixture of air and abrasive, particulate solids.

17. The method of claim 14 wherein said heat exchanger has a second header, said second header having spaced first and second walls defining a second manifold chamber therebetween, said tubes having second ends extending from said first wall of said second header and cooperating with said first wall of said second header to define a second set of tube openings providing open communication between said tubes and said second manifold chamber, each of said tube openings of said second set defining a peripheral seating surface, said second wall of said second header being provided with a plurality of bores, respective ones of said bores in said second wall of said second header being in register with respective ones of said tube openings of said second set, said method further comprising:

introducing a second tubular member through one of said bores in said second wall of said second header;

bringing said second tubular member into register with one of said tube openings of said second set in register with said bore through which said second tubular member is received and said tube opening of said first set, which is in register with said first tubular member;

releasably connecting said second tubular member to said second wall of said second header to establish a second pivot point whereby a force exerted around said second pivot point urges said second tubular member toward said first and second walls of said second header;

exerting said force to effect a substantial seal between said second tubular member and said seating surface of said tube opening of said second set; and conducting said fluidized cleaning medium through said second tubular member out of said tube so as to prevent said cleaning medium from depositing in said second manifold chamber.

* * * * *